United States Patent [19]

Niekamp et al.

[11] Patent Number: 4,894,625

[45] Date of Patent: Jan. 16, 1990

[54] RECTANGULAR WAVEGUIDE TO CIRCULAR WRAPPED RECTANGULAR WAVEGUIDE TRANSITION

[75] Inventors: Rex L. Niekamp; William A. Kerkhoff, both of Quincy, Ill.

[73] Assignee: Harris Corporation, Melbourne, Fla.

[21] Appl. No.: 277,230

[22] Filed: Nov. 29, 1988

[51] Int. Cl.[4] ..... H01P 5/02

[52] U.S. Cl. ..... 333/33; 333/21 R

[58] Field of Search ..... 333/21 R, 33, 254

[56] References Cited

U.S. PATENT DOCUMENTS

| | | | |
|---|---|---|---|
| 2,477,510 | 7/1949 | Chu | 333/157 |
| 2,962,677 | 11/1960 | Edwards | 333/33 X |
| 3,212,034 | 10/1965 | Kaufman et al. | 333/254 X |
| 4,556,853 | 12/1985 | Clark | 333/33 X |

*Primary Examiner*—Paul Gensler

*Attorney, Agent, or Firm*—Tarolli, Sundheim & Covell

[57] ABSTRACT

A transition is provided between a first rectangular waveguide and a second circular wrapped rectangular waveguide. The second waveguide takes the form of an elongated metallic annular wall having upper and lower ends and a partition member extending radially inward from the annular wall and having an inner edge located near the central axis of the annular wall. The partition member extends longitudinally for a length corresponding with that of the annular wall. An elongated metal probe is secured to the lower end of the partition member. The first rectangular waveguide has parallel rectangular broad walls interconnected by narrower walls. The first waveguide is oriented perpendicular to the central axis of the annular wall and has a circular aperture in one of the broad walls facing the lower end of the second waveguide with the aperture being in coaxial alignment with the annular wall. The first and second waveguides are secured together in such a manner that the probe extends through the aperture into the interior of the first waveguide.

9 Claims, 3 Drawing Sheets

RECTANGULAR WAVEGUIDE TO CIRCULAR WRAPPED RECTANGULAR WAVEGUIDE TRANSITION

BACKGROUND AND FIELD OF THE INVENTION

This invention relates to the art of waveguides and, more particularly, to providing a transition or coupling between two waveguides such as a circular wrapped rectangular waveguide and a rectangular waveguide.

Slotted cylindrical antennas have been used effectively in UHF broadcasting. One such antenna is a slotted length of circular wrapped rectangular waveguide which, in cross section, has a lunar appearance. Such a lunar waveguide is similar to that described in the prior art, such as in U.S. Pat. Nos. to L. J. Chu 2,477,510 and to S. A. Schelkunoff 2,199,083.

Such a lunar waveguide may be considered as an elongated circular wrapped rectangular waveguide having an elongated metallic annular wall having an upper end and a lower end. A partition member, known as a septum, extends radially inward from the annular wall. The inner edge of the septum may be rounded somewhat and is referred to as a ridge. This ridge is located near the central axis of the annular wall and extends along with the septum longitudinally for a length corresponding with that of the annular wall.

The input to such a lunar waveguide has typically taken the form of a coaxial input. One type of a coaxial input known in the art has included in a bottom fed construction wherein the inner conductor of the coaxial input was connected to the ridge and the outer conductor was connected to the annular wall of the lunar waveguide. Another form of coupling power to such a lunar waveguide has included a coaxial input mounted on the side of the waveguide. The inner conductor of the coaxial input extends through the annular wall of the waveguide and makes electrical connection with the ridge on the septum and the outer conductor of the coaxial input is electrically connected to the annular wall.

Problems have been noted with such connections of coaxial inputs to a lunar waveguide antenna, presenting a need to eliminate such coaxial connections. One of the problems noted is that the input power handling capability of such a waveguide antenna is much greater than the power handling capability of the coaxial input, thereby limiting the capability of the waveguide antenna to that of the coaxial input. If too much power is supplied to the coaxial cable, it will overheat and burn up. There are limitations in the diameter of such a coaxial input, as it is difficult to obtain a proper impedance match between such a coaxial connection and a transmitter due to higher order modes present in the coaxial cable.

Many high power UHF stations have found it desirable to utilize rectangular waveguide transmission lines to increase system efficiency in transmitting power from the transmitting equipment to the waveguide antenna. In order to remove the power handling restrictions encountered with the coaxial to lunar transition, it would be desirable to provide a rectangular waveguide to a lunar waveguide transition. This will eliminate the need for a coaxial section and thereby provide a pure waveguide system.

SUMMARY OF THE INVENTION

It is therefore a primary object of the present invention to provide a coupling transition between a rectangular waveguide and such a lunar type waveguide antenna to thereby increase the operating efficiency of the transmitting system.

In accordance with the present invention, apparatus is provided for making a transition coupling between a first rectangular waveguide and a second circular wrapped rectangular waveguide. The second waveguide takes the form of an elongated metallic annular wall having an upper end and a lower end with a partitioning member, such as a septum, which extends radially inward from the annular wall and having an inner edge thereof which is located near the central axis of the annular wall and extends longitudinally thereof for a length corresponding with the annular wall. An elongated metal probe is secured to the partition and extends beyond the lower end of the second waveguide. The first rectangular waveguide has parallel rectangular broad walls interconnected by parallel extending narrow walls. This first waveguide is oriented perpendicular to the axis of the annular wall of the second waveguide and has a circular aperture in one of its broad walls facing the lower end of the second waveguide and is in coaxial alignment with the annular wall thereof. The first and second waveguides are secured together in such a manner that the probe extends from the septum through the aperture into the interior of the first waveguide for effecting efficient coupling of electromagnetic energy therebetween.

BRIEF DESCRIPTION OF THE DRAWINGS

The foregoing and other objects and advantages of invention will become more readily apparent from the following description of a preferred embodiment, as taken in conjunction with the accompanying drawings which are a part hereof, and wherein.

DESCRIPTION OF A PREFERRED EMBODIMENT

Reference is now made to the drawings, wherein the showings are for purposes of illustrating a preferred embodiment of the invention and not for purposes of limiting same.

Figure 1:
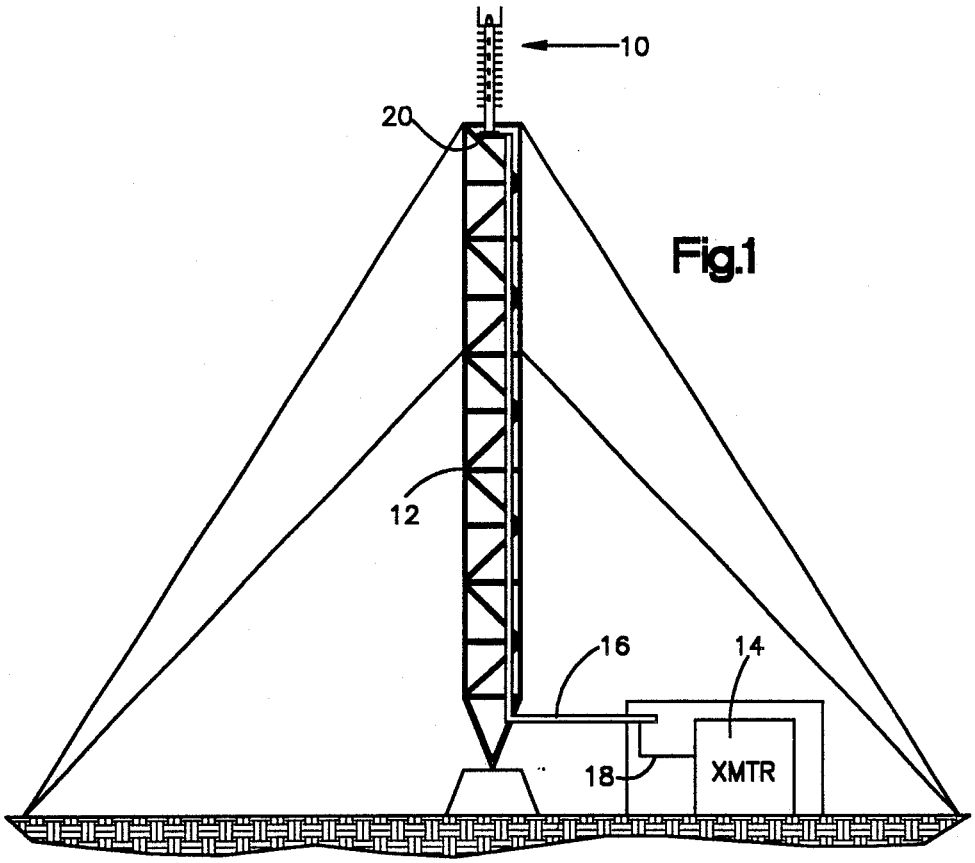
FIG. 1 is a schematic elevational illustration of a UHF antenna system incorporating the invention.

In FIG. 1 there is illustrated an elevational view of a UHF waveguide antenna 10 mounted on the top of a tower structure 12 of conventional design. The tower height may, for example, be on the order of 1,000 feet and the UHF waveguide antenna 10 may be on the order of 50 feet. At ground elevation, there is schematically illustrated an RF transmitter 14 which is supplying RF energy to a rectangular waveguide 16 by means of a coaxial cable 18. The waveguide 16 is mounted to the tower structure 12 and extends vertically upward alongside the tower and terminates in a horizontally extending rectangular waveguide transition 20 which feeds the UHF waveguide antenna 10. As will be brought out hereinafter, the UHF waveguide antenna 10 is circular in cross section and takes the form of a slotted length of circular wrapped rectangular waveguide having a lunar cross section. The invention herein is directed to making a transition between the rectangular waveguide 16 and the lunar waveguide, both preferably operating in the $TE_{10}$ mode of operation.

Figure 2:
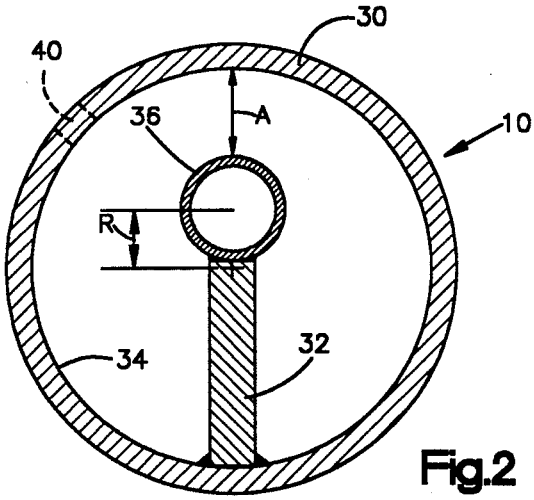
FIG. 2 is a cross sectional view illustrating the construction of a lunar waveguide antenna.

Reference is now made to FIG. 2 which illustrates the cross section of the UHF waveguide antenna 10. The waveguide antenna takes the form of an annular steel pipe or cylinder 30 having a partition wall or septum 32 extending radially inward from the inner wall 34 of the cylinder. The septum 32 is constructed of metal, such as steel, and may be secured to the inner wall 34 as by welding. The septum is coextensive with the longitudinal length of the cylinder 30. The inner edge of the septum is positioned near the central axis of the cylinder and is provided with an annular ridge 36. This ridge 36 may take the form of a circular pipe that is coextensive with the septum and is offset somewhat from the central axis of cylinder 30. A plurality of slots 40 are formed in the walls of cylinder 30. These slots extend longitudinally of the cylinder. The slots are not necessarily in alignment but may be skewed somewhat. Generally, the slots are located at an angle within the range of 20° to 50° from the plane defined by septum 32.

The RF energy propagating within the interior of the waveguide antenna 10 is typically longer than that of the energy propagated from the antenna in free space. For a particular UHF band, such as channel 68, the waveguide wavelength $W_G$ may be on the order of 16.6 inches, whereas the free space wavelength $W_F$ may be on the order of 14.81 inches. Attention is now given to the dimensions in wavelengths for the structure of FIG. 2. The outside diameter of the cylinder 30 may be on the order of 0.6 $W_F$, whereas the inner radius of the cylinder may be on the order of 0.22 $W_G$. The ridge 36, which may take the form of a cylindrical pipe has its central axis offset from that of the cylinder 30 by a distance R, and this distance may be on the order of 0.05 $W_G$. The ridge 36, when viewed in the plane of septum 32 is spaced by a distance A from the inner diameter of the cylinder 30. This distance A is preferably on the order of 0.10 $W_G$. It has been determined that a decrease in dimension A will cause a decrease in the guide wavelength $W_G$. Conversely, the guide wavelength $W_G$ will increase as the dimension A increases. The foregoing has been presented as background for understanding the manner in which a transistion takes place in accordance with the invention between waveguide section 20 and the lower end of the waveguide antenna 10 (FIG. 1).

Figure 3A:
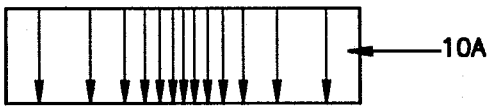
FIGS. 3A, 3B and 3C are simplified sketches of a rectangular waveguide being circularly wrapped to obtain a circular wrapped rectangular waveguide.
Figure 3B:
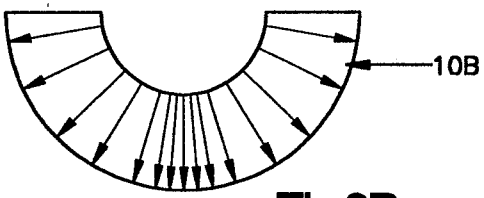
Figure 3C:
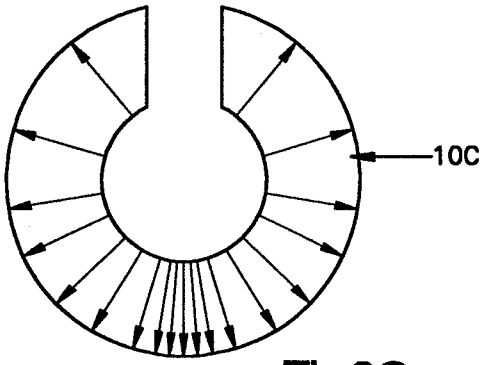

The cross section of waveguide 10, as best seen in FIG. 2, provides a waveguide interior which is somewhat lunar in shape and, hence, may be referred to as a lunar waveguide antenna. The energy propagating within the waveguide 10 is in the $TE_{10}$ mode which is normally considered a mode used by rectangular waveguides. Upon closer examination of FIG. 2, it will be noted that the interior of the waveguide is a length of circular wrapped rectangular construction. This may be more easily understood by configurations 10A, 10B and 10C in FIGS. 3A through 3C. FIG. 3A illustrates the cross section of a rectangular waveguide 10 operating in the $TE_{10}$ mode with the intensity of its electric field being as indicated by the arrows in FIG. 3A. This waveguide is circularly wrapped about itself and will take on the configuration as shown in FIG. 3B, and then finally as is shown in FIG. 3C. Note that the resultant configuration in FIG. 3C takes on a striking resemblance to that as shown in FIG. 2. The same results may be obtained with a cylinder 30, a septum 32 and an inner ridge 36. As in the case of FIG. 3C, the intensity of the electric field will be greatest in the area of dimension A of FIG. 2.

The object of the present invention is to make an efficient transition or coupling of RF energy from a rectangular waveguide operating in the $TE_{10}$ mode to a lunar waveguide antenna, as illustrated in FIG. 2, also operating in the $TE_{10}$ mode. Preferably, this transition is a waveguide-to-waveguide transition without employing a coaxial input to the lunar waveguide. Such a transition is illustrated in FIGS. 4–6.

Figure 4:
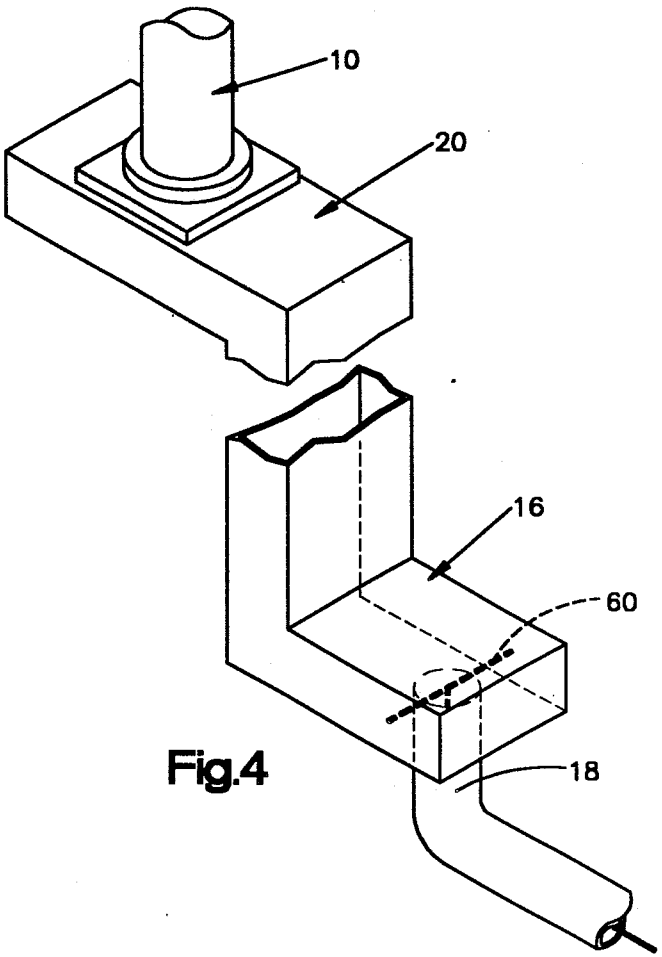
FIG. 4 is a schematic illustration of the invention.

As shown in FIG. 4, the coaxial cable 18 from the transmitter 14 (see FIG. 1) is connected to the rectangular waveguide 16 in a conventional fashion. The outer conductor of the cable is electrically connected to the bottom broad wall of the waveguide and the inner conductor extends into the waveguide and is terminated with a shorting bar 60 interconnected between opposing narrow walls of the waveguide. The vertical section of the waveguide extends up the tower 12 (FIG. 1) and may be coupled to the horizontal rectangular waveguide transition 20. The waveguide transition 20 has its upwardly facing broad wall coupled to the lunar waveguide 10 so as to make the waveguide-to-waveguide transition. This is illustrated in greater detail hereinafter.

Figure 5:
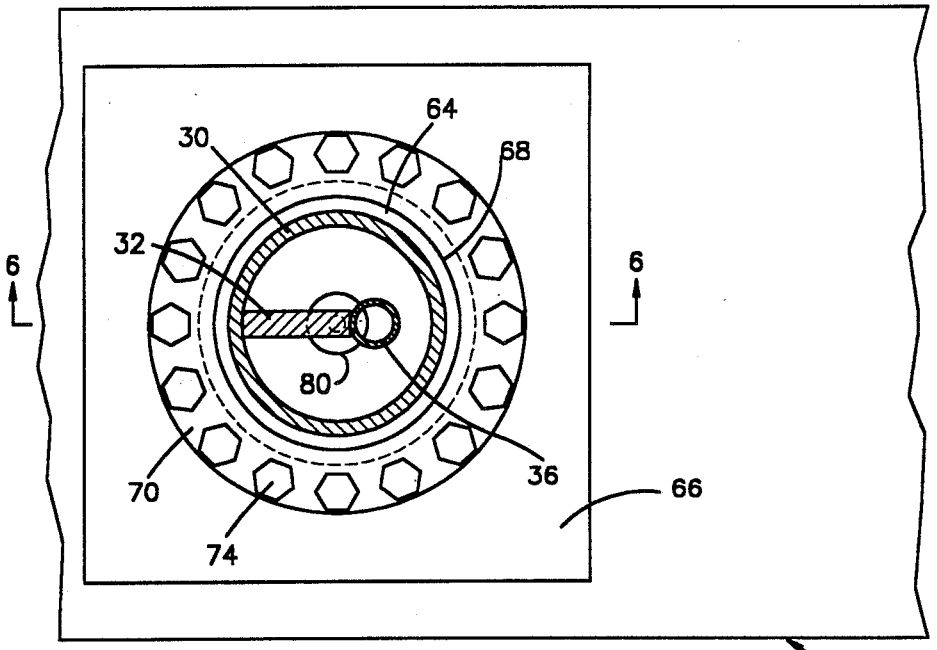
FIG. 5 is a cross sectional view illustrating the construction of the transition.
Figure 6:
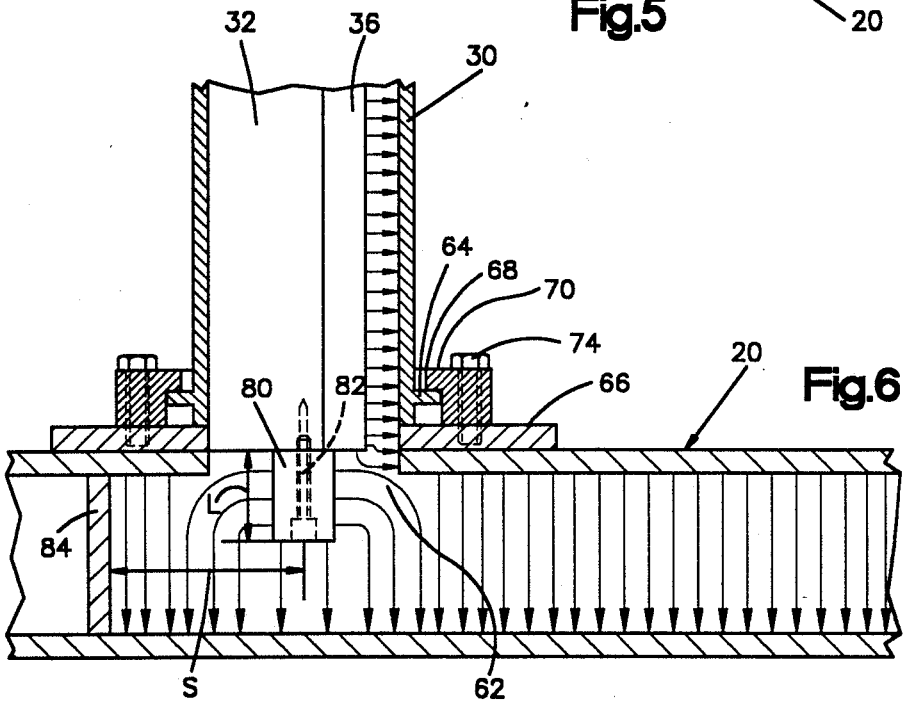
FIG. 6 is a sectional view taken along line 6—6 looking in the direction of the arrows in FIG. 5.

Reference is now made to FIGS. 5 and 6 which illustrate the preferred embodiment of the rectangular waveguide to lunar waveguide transition 20. As is seen, the cylinder 30 of the lunar waveguide 10 has its lower end mounted on the upper broad wall of the waveguide transition 20. The waveguide transition 20 has a circular opening 62 of a diameter corresponding with the inner diameter of the cylinder 30 of the waveguide antenna 10. The cylinder 30 has a circular flange 64 which extends radially outward and is spaced slightly above the lower end of the cylinder. The lower end of the cylinder rests on a mounting plate 66. The square shaped metal mounting plate 66 is secured to the upper broad wall, as by welding. This mounting plate 66 has a circular opening corresponding with that of opening 62 in the transition 20. An annular collar 70 has a central aperture 68 that coaxially surrounds the cylinder 30. This collar overlies both the annular flange 64 as well as the mounting plate 66.

The mounting plate 66 has an annular array of threaded holes 72. The annular collar 70 has a corresponding annular array of holes through which fastening bolts 74 may extend. In assembly, these fastening bolts extend through the annular array of holes in the collar and are threaded into and, secured in the threaded holes 72 in the mounting plate 66 to secure the waveguide transition 20 in place with the lunar waveguide antenna 10. This arrangement permits the bolts to be loosened so that the transition 20 may be rotated to a desired orientation relative to the lunar waveguide antenna before being secured in place. For example, as shown in FIGS. 5 and 6, the rectangular transition extends in a direction which is parallel to that of the septum 32 within the lunar waveguide antenna. It may be desirable that this be a perpendicular relationship and, if so, adjustments may be made to rotate the waveguide transition by 90° from that as shown in FIGS. 5 and 6.

As discussed hereinbefore, the rectangular waveguide operates in the $TE_{10}$ mode and the desired mode of operation of the lunar waveguide antenna 10 is also the $TE_{10}$ mode. In order to achieve propagation in the $TE_{10}$ mode from the waveguide transition 20 to the lunar waveguide antenna, a probe 80 is attached to the bottom of the septum and extends into the interior of the waveguide transition 20. The probe is circular in cross section and may be constructed of solid steel. The probe is mounted to the septum as by welding and/or by means of a bolt 82 which extends through a central bore in the probe and is threaded into the lower end of the septum 32. Preferably, this bore is recessed so that the head of the bolt 82 does not extend beyond the lower end of the probe. This is done to prevent corona from developing under high power operation. The electric field in the $TE_{10}$ mode is indicated by the arrows in FIG. 6.

Ideally, the probe has a length L on the order of 0.1604 $W_G$ and a diameter which may be on the order of 2.6 inches. The central axis of the probe is spaced from a shorting plate 84 by a distance S. The shorting plate 84 may take the form of a solid steel plate which closes off and terminates the antenna side of the waveguide transition. While illustrated as being a solid plate, the shorting plate 84 may take the form of a wire mesh screen to provide proper termination. It has been determined that an ideal spacing S of the shorting plate from the central axis of the probe may be on the order of 0.558 $W_G$. By adjusting the probe length and the position of the shorting plate 84 in the manner shown, an input VSWR of less than 1.1:1.0 has been achieved. The length and diameter of the probe are adjusted for purposes of matching the impedance of the lunar waveguide antenna to that of the rectangular waveguide. This has been achieved with the relationships discussed above. In a practical device, the rectangular transition 20 has been rotated relative to the lunar waveguide antenna at 90° steps and the impedance changes have been monitored. The test results indicated that a symmetrical $TE_{10}$ mode was being launched into the lunar waveguide antenna confirming that a pure waveguide to waveguide transition has been accomplished.

Whereas the invention has been described with respect to a preferred embodiment, it is to be appreciated that various modifications may be made without departing from the spirit and scope of the invention as defined by the appended claims.

Having described as preferred embodiment of the invention, we claim:

1. Apparatus for providing a direct waveguide to waveguide transition coupling between a first rectangular waveguide and a second circular wrapped rectangular waveguide with both waveguides operating in a $TE_{10}$ mode, comprising said second waveguide includes an elongated metallic annular wall having an upper end and a lower end and a partition member extending radially inward from said annular wall and having an inner edge thereof located near the central axis of said annular wall and extending longitudinal for a length corresponding with that of said annular wall, an elongated metal probe having one end secured to the lower end of said particular member at a location corresponding with said central axis and extending beyond said lower end;

said first rectangular waveguide having parallel rectangular broad walls interconnected by narrower narrow walls, said rectangular waveguide being oriented perpendicular to the axis of said annular wall and having a circular aperture in one of said broad walls facing said lower end, said circular aperture being in coaxial alignment with said annular wall; and means securing said first and second waveguides together with said probe extending through said aperture into the interior of said first waveguide.

2. Apparatus as set forth in claim 1 wherein said first waveguide has a transmitter end adapted for connection with a rectangular waveguide coupled to an RF transmitter and an antenna end with said circular aperture in said broad wall being located intermediate said antenna end and said transmitter end.

3. Apparatus as set forth in claim 2 including means for electrically terminating said antenna end of said first waveguide.

4. Apparatus as set forth in claim 3 wherein said means for electrically terminating includes a shorting plate interconnecting the walls of said first waveguide.

5. Apparatus as set forth in claim 3 wherein said means for terminating is spaced from the central axis of said annular wall by a distance greater than the length of said probe.

6. Apparatus as set forth in claim 3 wherein said probe is circular in cross section and is mounted to said partition member so as to be coaxially in alignment with the central axis of said annular wall.

7. Apparatus as set forth in claim 6 wherein said means for electrically terminating the antenna end of said first waveguide is spaced from the central axis of said annular wall by a distance greater than the length of said probe.

8. Apparatus as set forth in claim 7 wherein the wavelength of the energy propagating within said waveguides is of a wavelength $W_G$ and that the length of said probe is on the order of 0.16 $W_G$ and that said means for electrically terminating is spaced from the central axis of said annular wall by a distance on the order of 0.56 $W_G$.

9. Apparatus as set forth in claim 6 wherein said means for securing said first and second waveguides together is adjustable so that said first waveguide may be rotated about the central axis of said annular wall to achieve a desired orientation relative to the plane containing said partition member.

* * * * *